US006694704B1

(12) United States Patent
Ausnit

(10) Patent No.: US 6,694,704 B1
(45) Date of Patent: Feb. 24, 2004

(54) PROCESS AND APPARATUS FOR FORMING PACKAGING BAGS WITH A FASTENER

(75) Inventor: Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/633,944

(22) Filed: Aug. 8, 2000

Related U.S. Application Data

(62) Division of application No. 09/292,256, filed on Apr. 15, 1999, now abandoned.

(30) Foreign Application Priority Data

Apr. 20, 1998 (FR) ..... 98 04913
May 19, 1998 (FR) ..... 98 06292

(51) Int. Cl.[7] ..... B65B 61/18
(52) U.S. Cl. ..... 53/412; 53/133.4; 493/213
(58) Field of Search ..... 53/412, 133.4, 53/139.2; 156/66; 493/213, 927

(56) References Cited

U.S. PATENT DOCUMENTS 3,859,150 A * 1/1975 Van Amburg ..... 156/66
3,936,923 A * 2/1976 Cantor ..... 156/66
4,241,865 A * 12/1980 Ferrell ..... 156/66
4,335,817 A * 6/1982 Bahr ..... 53/412
4,620,320 A * 10/1986 Sullivan ..... 493/213
4,909,017 A * 3/1990 McMahon ..... 53/412
5,167,608 A * 12/1992 Steffens ..... 53/133.4
5,782,733 A * 7/1998 Yeager ..... 53/412
5,816,018 A * 10/1998 Bois ..... 53/133.4
6,017,412 A * 1/2000 Van Erden ..... 53/133.4
6,273,607 B1 * 8/2001 Buchman ..... 53/412
6,290,390 B1 * 9/2001 Buchman ..... 53/412

* cited by examiner

*Primary Examiner*—John Sipos
(74) *Attorney, Agent, or Firm*—Pitney, Hardin, Kipp & Szuch LLP

(57) ABSTRACT

A process for manufacturing a film for forming reclosable bags includes moving the film and attaching to the film sequentially and crosswise with reference to the direction of movement of the film, a fastener including a first strip supporting at least one reclosable profile engaged with another reclosable profile that is complementary thereto and that is supported by a second strip or a part of the first strip, which will subsequently be attached to the film. Each strip includes at least one web extending substantially mostly sideways on one side of the profiles. The above arrangements make possible special fasteners that include sliders, gasket membranes, fasteners inverted within the bag, peel-seals and hinged fasteners.

7 Claims, 13 Drawing Sheets

FIG. 1A
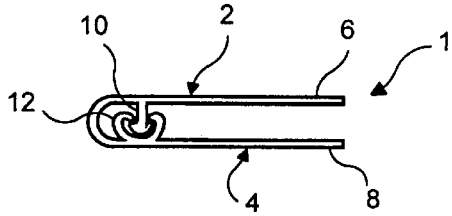
FIG. 1B
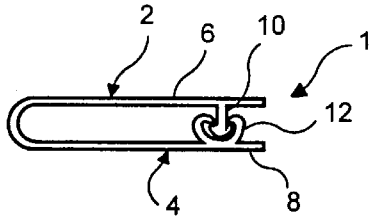
FIG. 1C
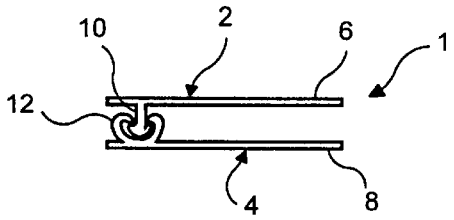
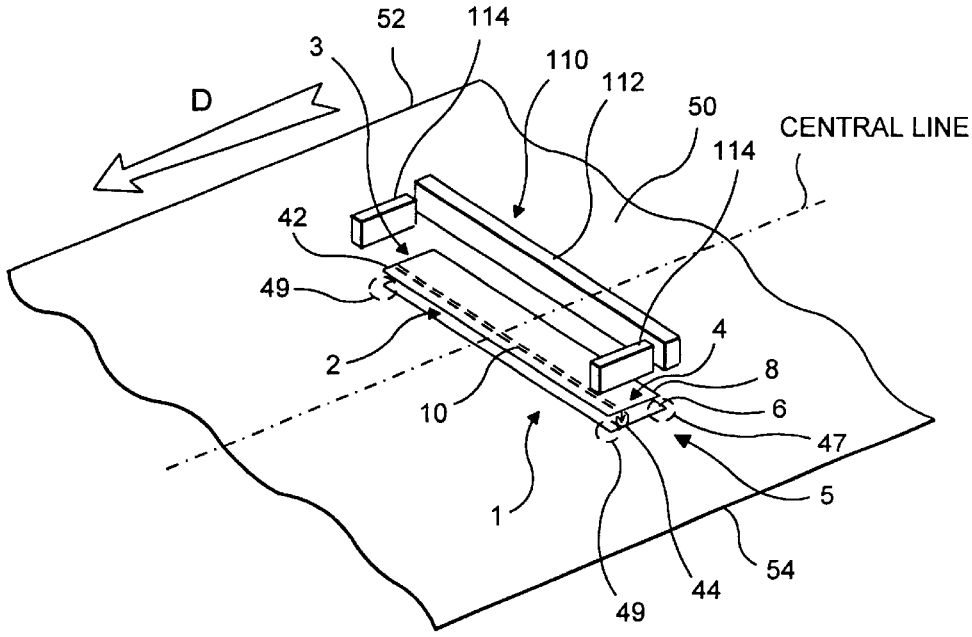
FIG. 2

PROCESS AND APPARATUS FOR FORMING PACKAGING BAGS WITH A FASTENER

CROSS REFERENCE TO RELATED APPLICATIONS

This is a division of U.S. patent application Ser. No. 09/292,256 filed on Apr. 15, 1999 now abandoned.

BACKGROUND OF THE INVENTION

1. Field of the Invention

This invention relates to automatic package forming, filling and sealing machines involving fasteners, for example with complementary male and female profiles. This type of machine is often referred to as an FFS ("Form, Fill and Seal") machine.

2. Description of the Prior Art

U.S. Pat. No. 4,909,017 to McMahon et al. describes a process in which bags are provided with a fastener when they are formed on an FFS machine. The bags are formed from a film of thermoplastic material. The film is in the form of a strip of material extending between two free edges that are longitudinal with reference to the movement of the film. This film is unrolled upstream of a filling tube. The fastener is positioned on the film, also upstream of the spout and transversely with respect to the direction of movement of the film. The fastener consists of two strips provided with complementary profiles. A first strip of the fastener is welded to the film upstream of the tube, on a portion of the film which is intended to form a first bag wall. The bag is then formed by enveloping the tube and welding the two longitudinal edges of the film. The second fastener is then welded below the tube to a second bag wall.

U.S. Pat. No. 4,655,862 to Christoff et al. also describes a process for forming reclosable bags on FFS machines, in which bags are provided with a fastener that is positioned at right angles to the direction of formation of these bags. This fastener is placed below the filling tube on a film in the form of a single strip. This strip includes at least one fold zone crosswise to the strip so that the strip can be folded back on itself, and areas of the strip that can work together to seal the bag can be brought opposite one another.

It is therefore an object of the present invention is to make the steps involving the support, welding and installation of the fastener on the film easier to perform than in the processes described in the above-cited references.

SUMMARY OF THE INVENTION

The above and other beneficial objects are attained by providing a process for the fabrication of a film intended to form the bags, including steps of moving the film and fixing fasteners sequentially on the film and transversely with reference to the direction of movement of the film. The fastener consists of a first strip supporting at least one reclosable profile in engagement with another reclosable profile, which is complementary thereto and supported by a second strip or part of the first strip. The second strip or part of the first strip that supports the other profile will be subsequently fixed to the film. Each strip has at least one web extending substantially laterally on one side of the profile or profiles supported thereby.

These webs give the invention a number of advantages. Due its larger cross-section, a fastener for implementing the process according to the invention is easily moved and positioned. In addition, the webs can be attached at sufficiently low temperatures as to prevent damaging the profiles.

It is also possible for the step of attaching the fastener to the film to be performed by sealing the film with at least one area of these webs different from the area located under the profiles to prevent damage to the profiles during the attaching step.

BRIEF DESCRIPTION OF THE DRAWINGS

The above and other aspects, purposes and advantages of the invention will be apparent from a reading of the following detailed description. The invention will also be more fully understood when read in conjunction with the drawings in which:

FIG. 1 is a perspective view of three examples of fasteners for embodying the process according to the invention;

FIG. 2 is a perspective view of a fastener and means for welding the fastener onto a film intended to form reclosable bags using the process according to the invention;

DETAILED DESCRIPTION OF THE PREFERRED EMBODIMENTS

Figure 3:
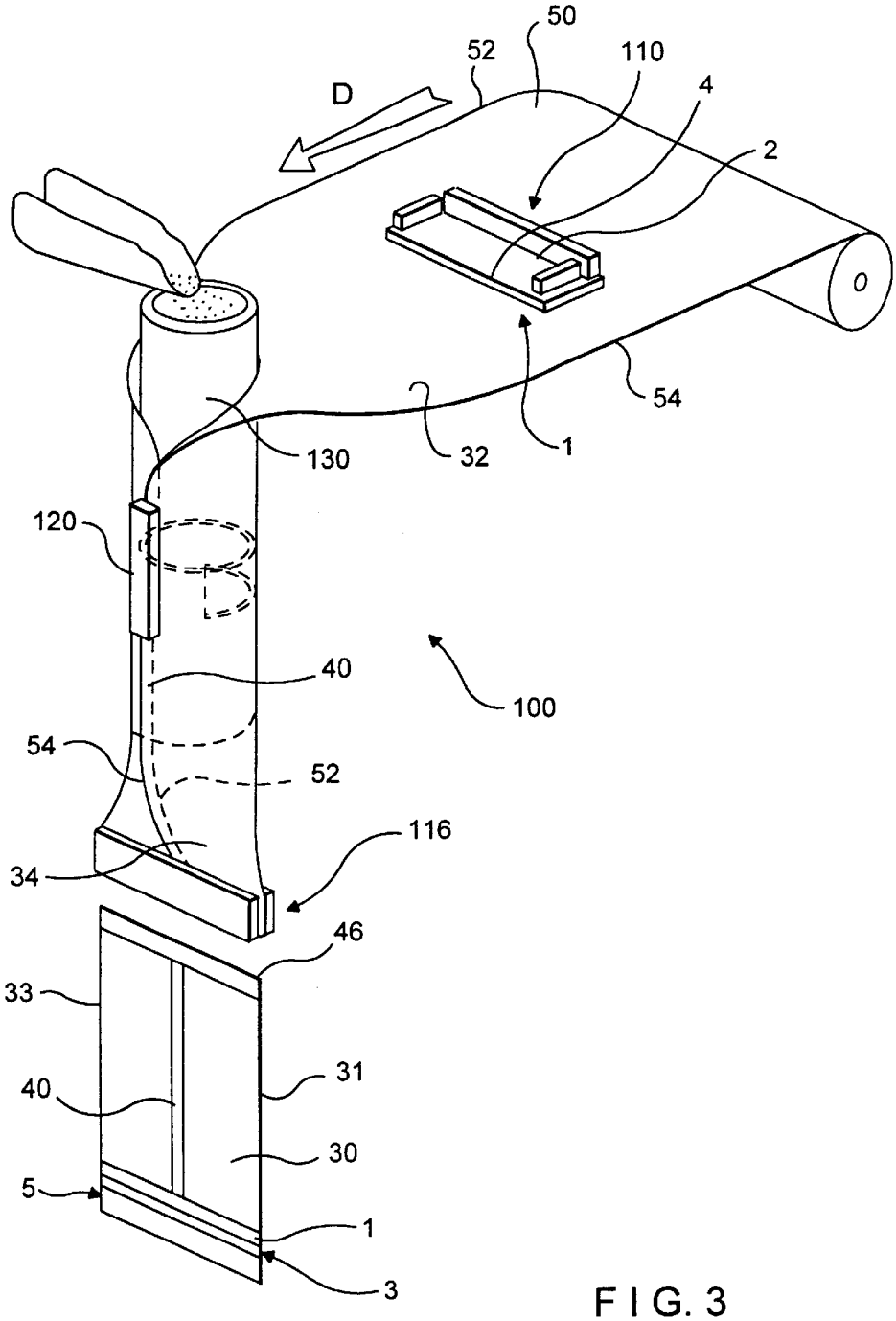
FIG. 3 is a perspective view of first and second means of welding the fastener, located upstream and downstream, respectively, of a filling tube of a bag forming machine according to the invention.

Those skilled in the art will gain an appreciation of the invention when viewed in conjunction with the accompanying drawings of FIGS. 1–25, inclusive. The individual reference characters designate the same or similar elements throughout the several drawings.

FIG. 1 shows three fasteners 1 for embodying the process according to the invention. These fasteners 1 include two strips 2, 4. The strips 2, 4 respectively include webs 6, 8 and fastener profiles 10, 12. Profiles 10, 12 extend on the strips 2, 4 in the longitudinal direction thereof. Profiles 10, 12 have forms capable of interlocking in a complementary manner. For example, one of the profiles 10, known as the male profile, has, in cross-section, the shape of an arrowhead. Profile 10 can be introduced and kept engaged in profile 12, known as the female profile, which is in the form of a groove. Each strip 2, 4 can have a number of profiles 10, 12, similar, for example, to those described above. These profiles 10, 12 are then parallel to each other. Strips 2, 4 respectively include a first web 6 and a second web 8, which extend substantially laterally on one side of profiles 10, 12.

According to certain variants of the invention, the first web 6 and the second web 8 can be replaced by a first part 6 and second part 8 of a single web that makes it possible to join the two strips 2, 4.

The fasteners shown in FIGS. 1*a* and 1*b* include two complementary profiles 10, 12. Each profile 10, 12 is supported by one of the two parts 6, 8 of a single web, which has a U-shaped cross-section with respect to the longitudinal direction of profiles 10, 12. Profiles 10, 12 of the fastener 1 shown in FIG. 1*a* are close to the bottom of the U-shaped cross-section. Profiles 10, 12 of fastener 1 shown in FIG. 1*b* are close to the free ends of the U-shaped cross-section. Webs 6, 8 of fastener 1 shown in FIG. 1*c* are independent of each other. Profiles 10, 12 of the fastener 1 shown in FIG. 1*c* are close to one free edge of webs 6, 8.

These fasteners 1 are particularly adapted to be attached to the film 50 by the process according to the invention, since the surface of webs 6, 8 permits welding of these webs 6, 8 onto the film 50 on an area of the webs that is not under profiles 10, 12. This facilitates placement of the fastener 1 and welding the same to the film 50. Preferably, at least one web 6, 8 extends sideways onto an area at least equal in surface area to the area located under profiles 10, 12. Preferably, the process according to the invention is used to form reclosable bags 30 on an FFS 100 machine.

In this case, during the process according to the invention, the step of attaching the first web 6 to a film 50 is executed upstream of a filling tube 130 of the FFS 100 machine. FIG. 2 shows a portion of the film 50 to be used to form the reclosable bags 30. The film 50 moves toward the tube 130 in the direction indicated by arrow D. The film 50 has two free longitudinal edges 52, 54 parallel to its direction of movement.

A fastener 1 is brought crosswise with respect to the direction D of movement of the film 50. Fastener 1 is oriented toward the film 50 so that the longitudinal direction of profiles 10, 12 is perpendicular to the longitudinal edges 52, 54 of the film 50. Fastener 1 can be any one of the three fasteners 1 shown in FIG. 1 or may be any other fastener 1, including those shown herein below, adapted for implementation of the process according to the invention.

Preferably, the length of the fastener 1 is approximately equal to half the size of the film 50, with respect to the direction of movement D thereof. The fastener 1 may be placed near one of the free longitudinal edges 52, 54 of film 50. Preferably, fastener 1 is attached approximately centered with respect to the two free longitudinal edges 52, 54. Fastener 1 is guided, pulled or pushed by roller-equipped means and/or by a two-way mechanism so that it is properly positioned on the surface of the film 50. Fastener 1 is positioned on a portion of the film 50 suitable for forming a first bag wall 30 so that one of the two strips 2, 4 is placed flat on one face of the film 50. In FIG. 2, strip 2 with web 6 rests on the surface of the film 50. Fastener 1 is advantageously provided, prior to being positioned on the film 50, with two spot welds 42, 44. Each spot weld 42, 44 is situated at one longitudinal end 3, 5 of the strips 2, 4, and, more particularly, at the location of profiles 10, 12 and thus helps to ensure that the fastener 1 is watertight at the longitudinal ends of the profiles 10, 12.

Fastener 1 is placed on the film 50 under first transversal welding means 110. These first transversal welding means 110, for example, include a welding bar 112 that is crosswise with respect to the direction of movement D of the film 50 and two welding bars 114 that are longitudinal with respect to the direction of movement D of the film 50. The length of the welding bar 1 12 is approximately equal to that of fastener 1. The two welding bars 114 are located at the ends of welding bar 112, at right angles thereto, and welding bars 114 are approximately equal in length to the width of fastener 1. The welding bars 112, 114 are lowered and pressed onto the edge of webs 6, 8 either together or independently of each other.

Thus, according to one variant of the process, the step of attaching the first web 6 to the film 50 is performed only at the longitudinal ends 3, 5 of the strips 2, 4, by to the longitudinal welding bars 114. According to another variant of the process, the first web 6 is attached to the film 50 through the welding bar 112, only on the edge of the web 6 which is going to be toward the outside of the reclosable bag 30 with respect to profiles 10, 12 when this reclosable bag 30 is formed. According to still another variant of the process, the first web 6 is attached upstream of the tube 130 by combining the two preceding variants.

Figure 21:
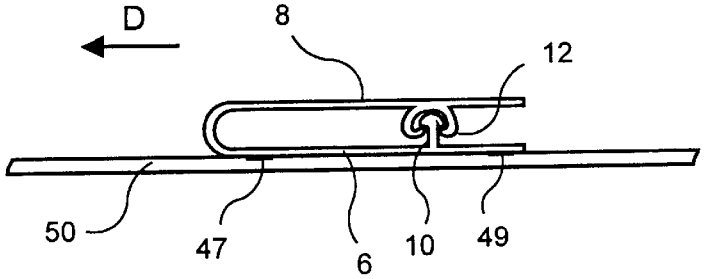
FIG. 21 is a cross-sectional view of a variant of the attachment of a fastener on a film.
Figure 22:
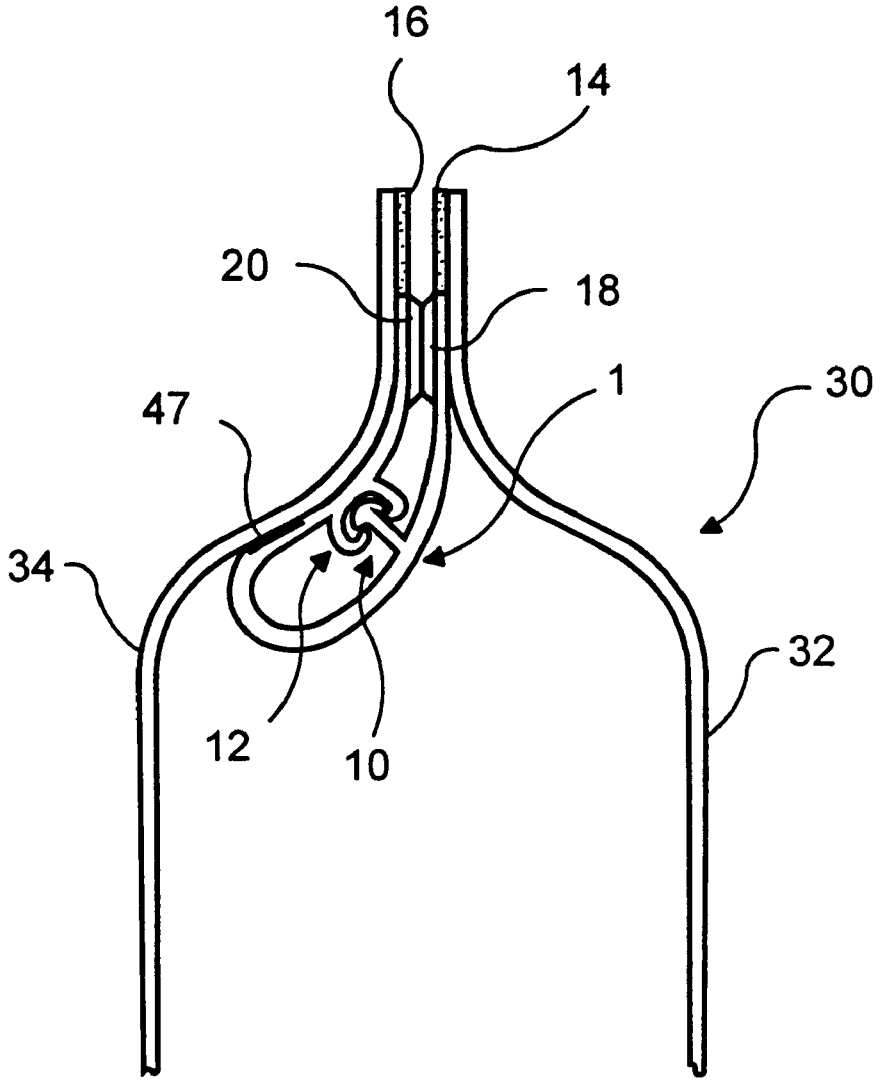
FIG. 22 is a cross-sectional view of the top of a reclosable bag with a fastener attached to the bag according to a variant of the process according to the invention.

Alternatively, for certain fasteners 1, the first web 6 is attached at no less than two points 47, 49 situated on either side of the profile 10 supported by web 6, with respect to the longitudinal direction. The first web 6 is thus part of the film 50 at a given point toward the front and at a point located to the rear with respect to the direction of movement D. This makes it possible to prevent fastener 1 from being turned around during the formation of the reclosable bag 30 on the tube 130 (FIGS. 2 and 21). A machine according to this invention can also allow implementation of this variant of the process.

Alternatively, the fastener 1 can be attached to the film 50 prior to forming the reclosable bag 30, at the same time the spot welds 42, 44 are being made. In this case, the fastener 1 is moved on the film 50 even if the spot welds 42, 44 have not been made. Then, once the fastener 1 is in place, appropriate longitudinal welding bars 114 weld the longitudinal ends 3, 5 of strips 2, 4 in the same operation that makes the weld points 42, 44.

FIG. 3 shows the formation of a reclosable bag 30 from the film 50 around the tube 130. The film 50 with a fastener 1 is conveyed toward the tube 130. The film 50 is then wrapped around tube 130. The free longitudinal edges 52, 53 are positioned one over the other parallel to the axis of the tube 130, to be welded to one another by longitudinal welding means 120, which is capable of forming a longitudinal weld seam 40. By folding the film 50 in this way, longitudinally with respect to its direction of movement, a second wall 34 of reclosable bag 30 is formed.

A reclosable bag 30 has two longitudinal folds 31, 33 and an opening that is closed by fastener 1. The reclosable bag 30 is hermetically sealed by the longitudinal weld 40 and one transversal weld 46. The transversal weld 46 extends between the longitudinal folds 31, 33 and is located on the edge of the walls 32, 34 longitudinally opposed to the fastener 1.

Figure 4:
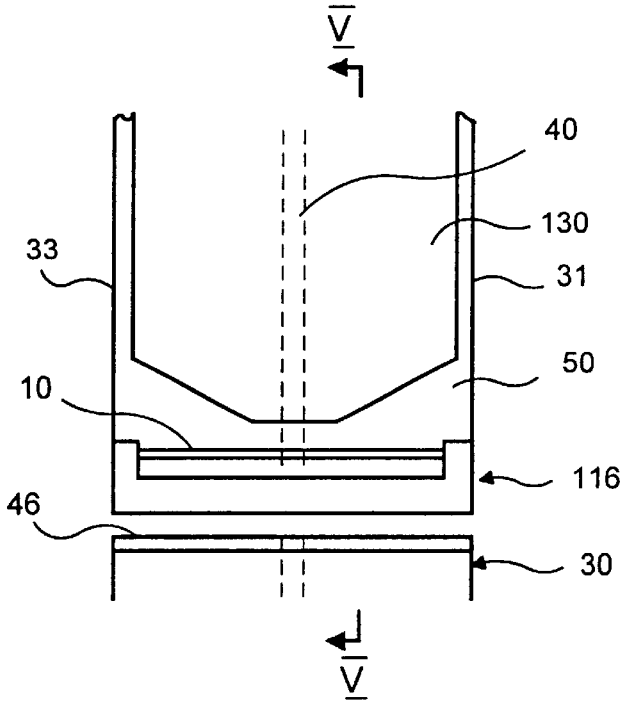
FIG. 4 is a top plan view of the second welding means of the bag-forming machine.

FIG. 4 shows second transversal welding means 116. These second transversal welding means 116 are adapted to attach the second web 8 of fastener 1 to the second wall 34 of reclosable bag 30 below the tube 130.

Figure 5:
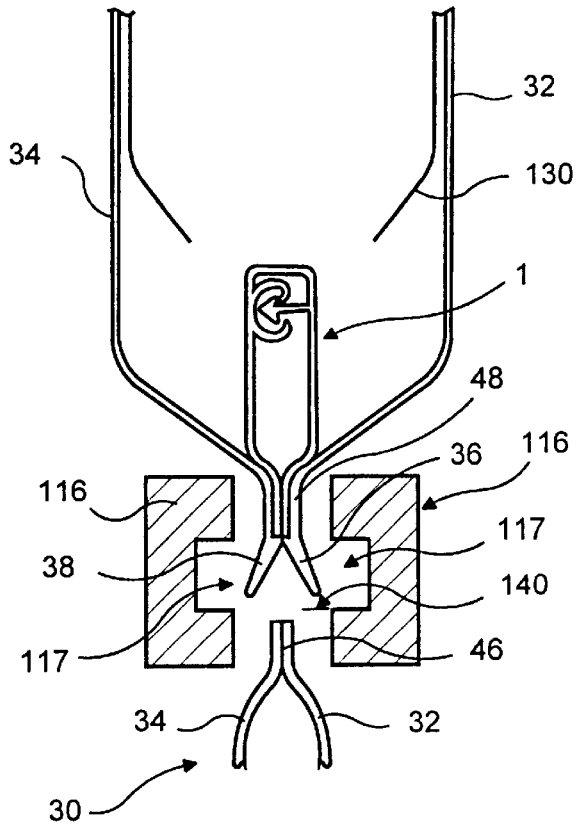
FIG. 5 is a cross-sectional view of the filling tube and the second welding means taken along the line V—V of the bag forming machine shown in FIG. 4.

As shown in FIG. 5, the second transversal welding means 116 simultaneously make it possible to weld the fastener 1 to the walls 32, 24 and to form the transversal weld 46. Preferably, cutting means 140 are joined solidly to second transversal welding means 116, in order to cut successive bags 30. These cutting means 140 can form a cut that is crosswise to the direction of movement of the film 50.

Preferably also, the second transversal welding means 116 each include a groove 117, which extends over the entire length of the second transversal welding means 116. The grooves 117 of each of the second welding means 116 are facing one another and are turned toward one another to form a cavity. These grooves 117 make it possible to avoid welding the walls 32, 34 in a small transversal area downstream of the fastener 1. This transversal area makes it possible to form tongues 36, 38 that allow the walls 32, 34 to be grasped to spread the same apart and to open up the reclosable bag 30.

Figure 3A:
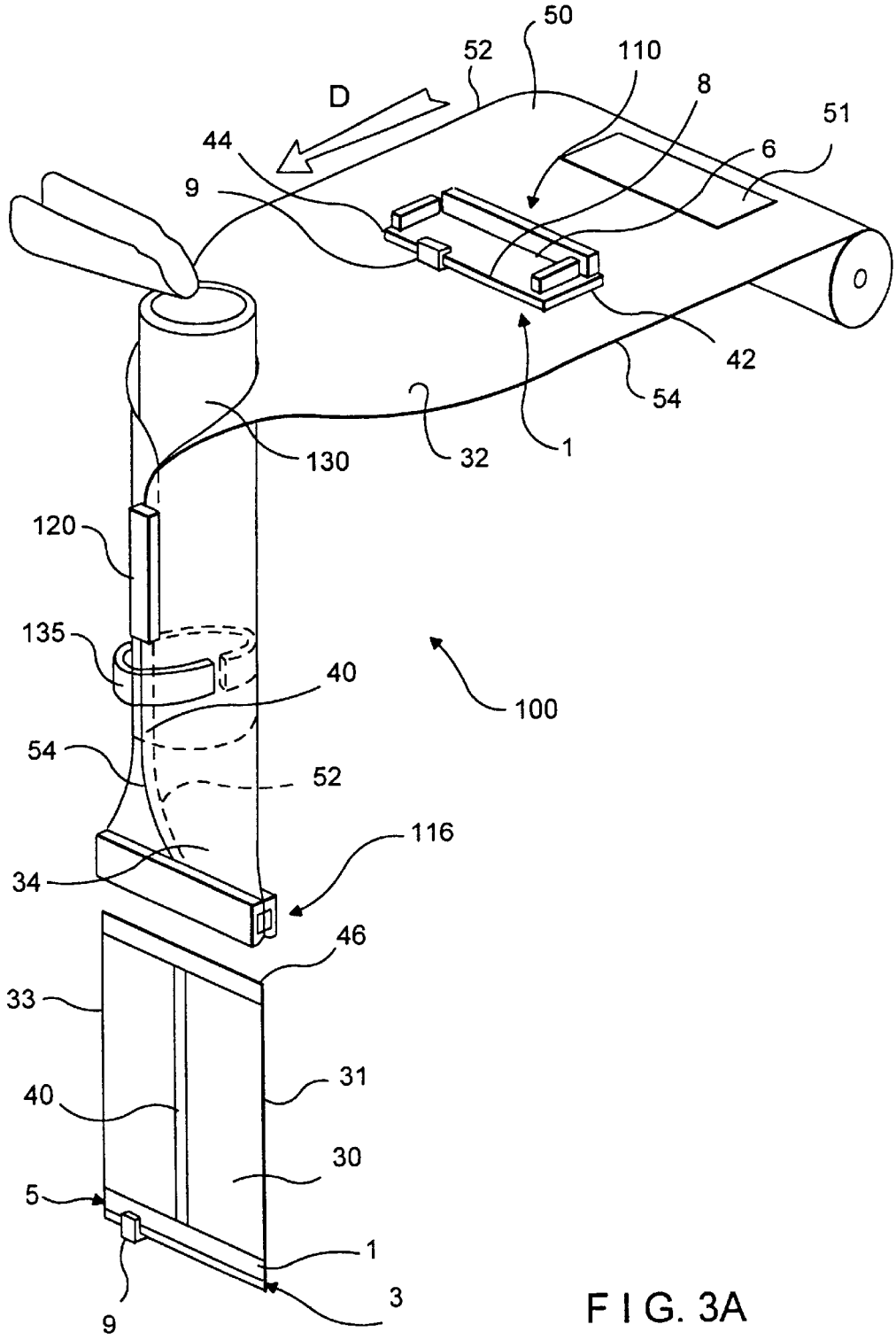
FIG. 3A is a perspective view of a variant of the bag forming machine that is adapted for fixing fasteners, which include a slider.
Figure 5A:
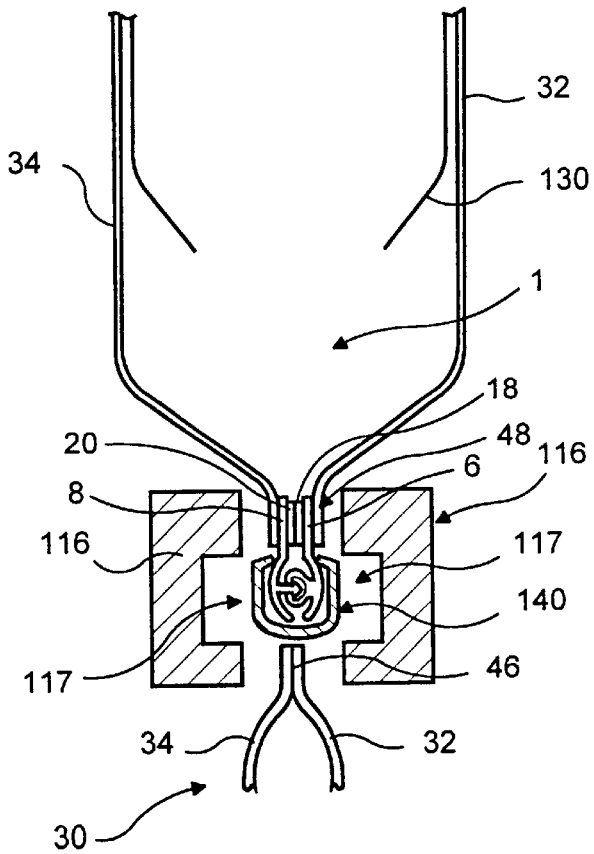
FIG. 5A is a cross-sectional view of a variant of the second welding means, which is adapted for attaching fasteners that include a slider.

A number of additional variants of the fastener 1 for implementing the process according to the invention will be described herein below. According to one of these variants, the fastener 1 includes a slider 9 (FIG. 5A). Slider 9 can be of any known type capable of engaging the profiles 10, 12 when moved in a first direction and disengaging the profiles 10, 12 when moved in a second direction opposite the to first direction. The process for making film 50 must be adapted to attach fasteners 1 with such a slider 9. In particular, as shown in FIG. 3A, the process includes a step of positioning film 50, which includes first cut-outs 51, below the tube 130. The first cut-outs 51 permit access to the slider 9 over the entire length of the profiles 10, 12. For example, the form and dimensions of first cut-outs 51 are slightly smaller than those of the fastener 1. These first cut-outs 51 are spaced apart on the film 50 by a distance equal to the dimension of the reclosable bag 30 in the direction parallel to movement D of the film 50. The process then includes a step of positioning fastener 1 on each of the first cut-outs 51, below the filling tube 130.

The fastener 1 is already provided with slider 9, and the longitudinal ends 3, 5 are possibly already welded together at spot welds 42, 44. The fastener 1 is therefore positioned so that the slider 9 is on the longitudinal edge of the fastener 1, located toward the front with respect to the direction of movement D of the film 50. At least one of the webs 6, 8 is then welded to the film 50 on at least at one edge of the first cut-outs 51 by the first transversal welding means 110. The film 50 thus provided with fasteners 1 is shaped in the form of a cylinder around the tube 130. A longitudinal weld 40 is formed by the longitudinal welding means 120. A second cut-out 53 is made downstream of the longitudinal welding means 120. This second cut-out 53 is made in the film 50 opposite to the first cut-out 51. The shape and dimension of this second cut-out 53 are the same as those of the first cut-outs 51. The second cut-outs 53 are made by a blade 135. If blade 135 is located at the location of the tube 130, the blade 135 is curved. The fastener 1 is then welded by the second transversal welding means 116. The shape of second transversal welding means 116 is adapted to weld fasteners 1 that include slider 9.

Figure 4A:
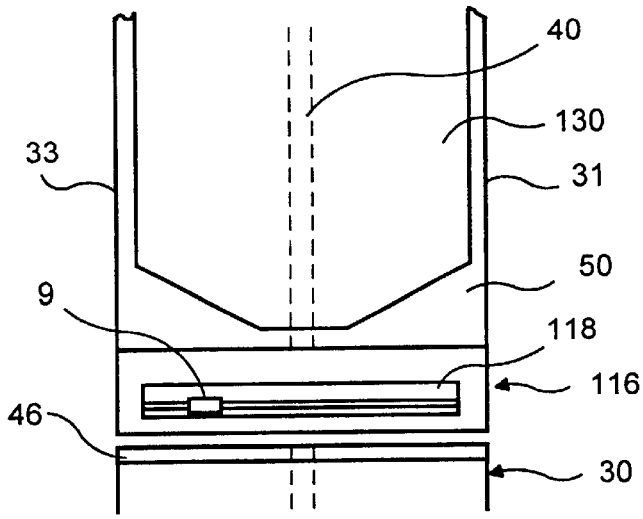
FIG. 4A is a top plan view of the second welding means of the variant of a bag forming machine, which is adapted for attaching fasteners that include a slider.

Examples of transversal welding means 116 are illustrated in FIGS. 4A and 5A. As shown in FIG. 4A, the second transversal welding means 116 includes an opening 118. This opening 118 is parallel to profiles 10, 12 and is approximately equal in length to the profiles 10, 12. This opening is wide enough so that the welding bars of the second welding means 116 are not applied to the slider 9 during welding of the fastener 1 onto the film 50. The welding means 116 therefore weld only webs 6, 8 of the fastener 1 to film 50, along with the longitudinal ends 3, 5 of strips 2, 4. The second welding means 1 16 thus form transversal welds 46 and 48 of reclosable bag 30.

As shown in FIG. 5A, according to another variant of the second transversal welding means 116, these means have a U-shaped cross-section. This shape creates grooves 117 that form a cavity capable of receiving profiles 10, 12 and the slider 9 without deforming them when the welding bars of the second welding means 116 are pressed against each other to form the transversal welds 46 and 48. The peel seal strips 18, 20 may be positioned between the webs 6, 8 of the side of the webs 6, 8 intended to be toward the inside of the reclosable bag 30.

Other methods can be envisaged for attaching a fastener 1 with a slider 9 to a film 50. In particular, it is possible to clear access to the slider 9 when making the cut-outs 51, 53 in ways other than those described above.

It may also be envisaged that the tube 130 can be provided with a longitudinal groove or guiding ribs capable of guiding the slider 9 when the fastener 1 moves over tube 130. Additionally, a forming collar may be provided with a trough leading to a groove that guides the slider into precise alignment with the longitudinal groove or guiding ribs of the tube 130.

Figure 6:
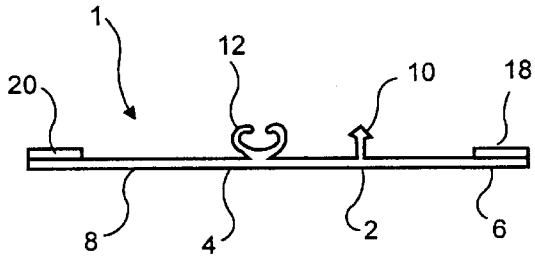
FIG. 6 is a cross-sectional view of an example of a fastener for embodying the process according to the invention.

FIG. 6 shows a fastener 1 which has, in addition to webs 6, 8 and profiles 10, 12, two strips 18, 20 that can form a peel seal. Peel seal strips 18, 20 extend over the entire length of the fastener 1, at the edges of the free ends of the webs 6, 8. Peel seal strips 18, 20 thus join the webs 6, 8 or parts of webs, on the side that will be located toward the outside of the reclosable bag 30 with respect to profiles 10, 12 after the reclosable bag 30 is fully formed.

Figure 7A:
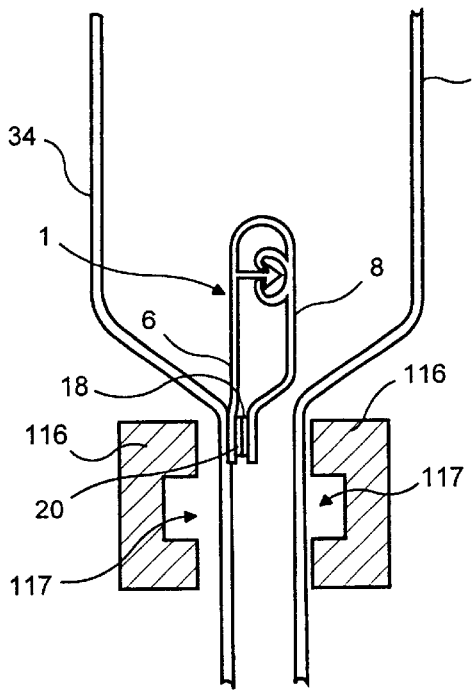
FIGS. 7*a* and 7*b* are cross-sectional views that are crosswise to the length of the fastener shown in FIG. 6, showing second welding means and means for cutting of the bag forming machine.
Figure 7B:
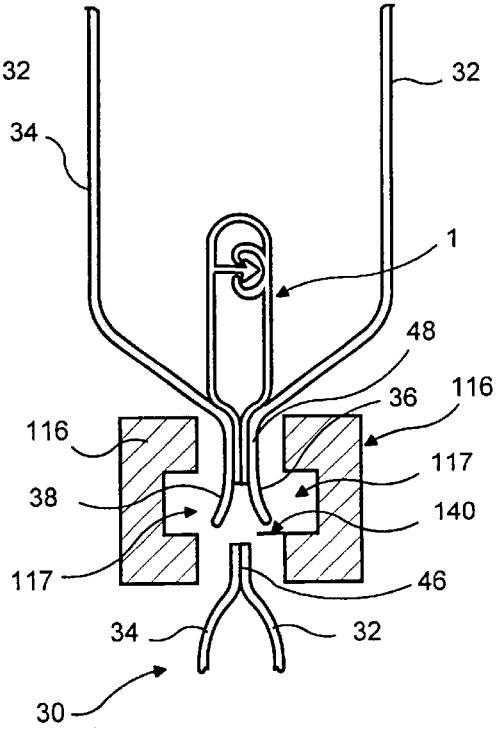

FIG. 7*a* illustrates, with regard to the second transversal welding means 116, the positioning and welding of the fastener 1 to the walls 32, 34. The fastener 1 shown in FIG. 6 is shown in FIG. 7*a* in a closed configuration. The peel seal strips 18, 20 are prewelded to one another. The free end of web 6 of fastener 1 is attached to the wall 34 by the first welding means 110. It is possible, according to one variant of the process, that the peel seal strips 18, 20 are not prewelded and are then welded together and to the wall 34 during the step of attaching the web 6 to this wall 34 by the first welding means 110. According to still another variant of the process, the entire set of walls 32, 34, webs 6, 8 and peel seal strips 18, 20 are welded by the second transversal welding means 116. After the wall 32 has been brought close to the free edge of web 8, the process of attaching fastener 1 to the walls 32, 34 is completed at the same time that the weld 46 is formed and at the same time that the walls 32, 34 between the weld 46 of a reclosable bag 30 and the fastener 1 of the following reclosable bag (FIG. 7*b*) are cut. As described above, the groove 117 of the second transversal welding means 116 makes it possible to keep two areas of the walls 32, 34 unwelded in order to create tongues 36, 38 on the side of the profiles 10, 12 situated toward the outside of the reclosable bag 30.

Figure 8:
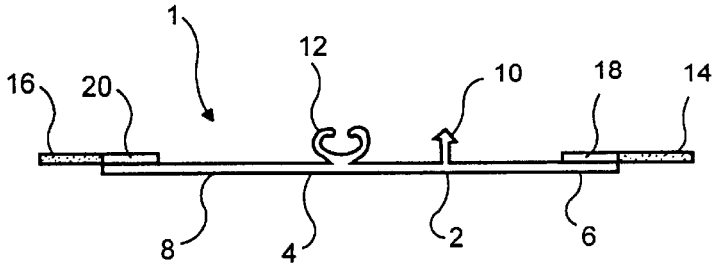
FIG. 8 is a cross-sectional view of another example of a fastener for embodying the process according to the invention.
Figure 9A:
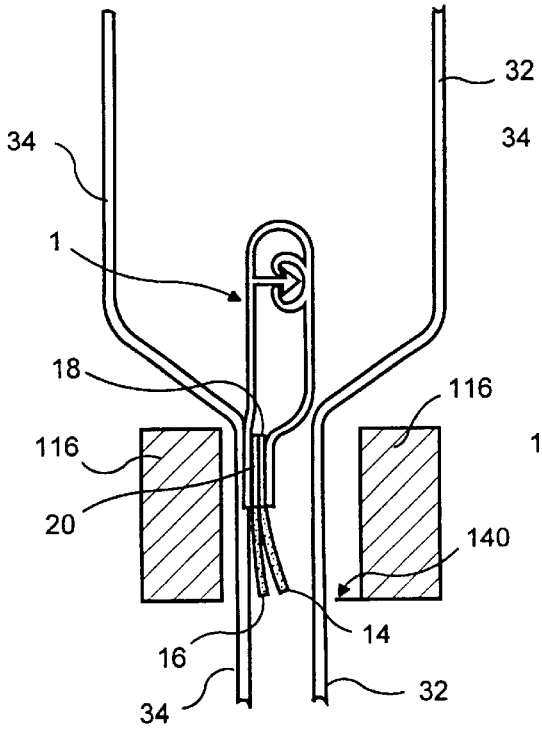
FIGS. 9A and 9B are a cross-sectional view that is crosswise to the length of the fastener shown in FIG. 8, of the second welding means and of the cutting means.
Figure 9B:
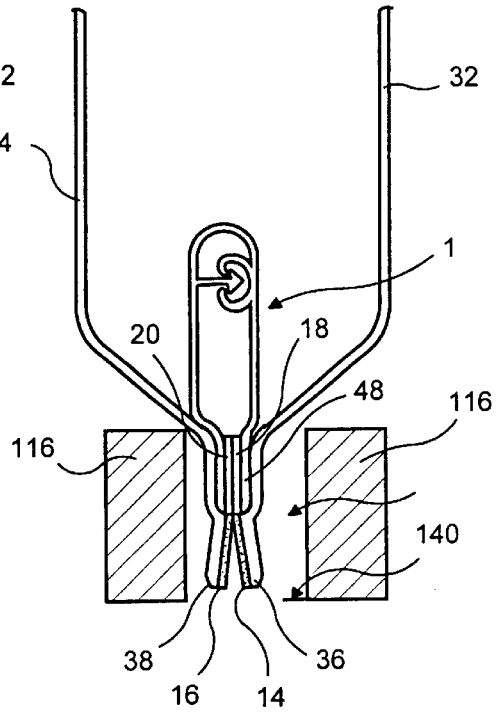

FIG. 8 shows a fastener 1 with two protective bands 14, 16. These protective bands 14, 16 extend over the entire length of the free longitudinal edges of the webs 6, 8. These protective bands 14, 16 are equipped with a barrier layer on the faces that are to be placed opposite each other, which prevents the protective bands 14, 16 from being welded together. As shown in FIG. 9, fastener 1 is welded to the walls 32, 34 by second transversal welding means 116, which do not have grooves 117. FIG. 9*b* shows that the walls 32, 34 are welded to the fastener 1 both at the location of the peel seal strips 18, 20 and at the location of the protective bands 14, 16. The protective bands 14, 16 are not welded together. Thus, tongues 36, 38 are formed, which are capable of grasping the walls 32, 34 of the reclosable bag 30 in order to open the reclosable bag 30.

Figure 10:
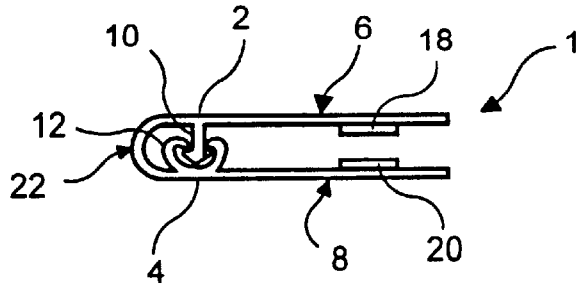
FIG. 10 is a cross-sectional view of another example of the fastener.

FIG. 10 is a cross-sectional view of a fastener 1, which is provided with a perforated line 22. The perforated line 22 is, when the fastener 1 is in an open position, located between profiles 10 and 12 at approximately equal distances therefrom. This perforated line 22 extends over the entire length of the fastener 1 at the bottom of the U-shaped groove formed by the fastener 1 when it is in a closed position. After the reclosable bag 30 is opened, the fastener 1 is tom at the perforated line 22 by separating the peel-seal strips 18, 20 and the profiles 10, 12.

Figure 11:
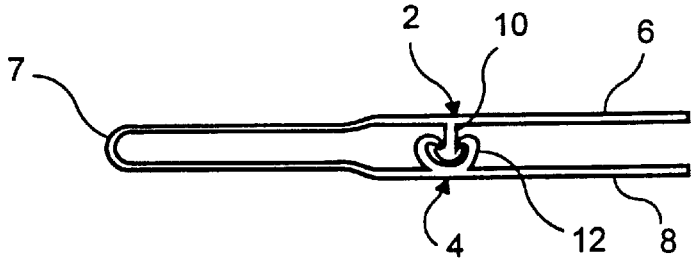
FIG. 11 is a cross-sectional view of yet another example of the fastener.
Figure 12:
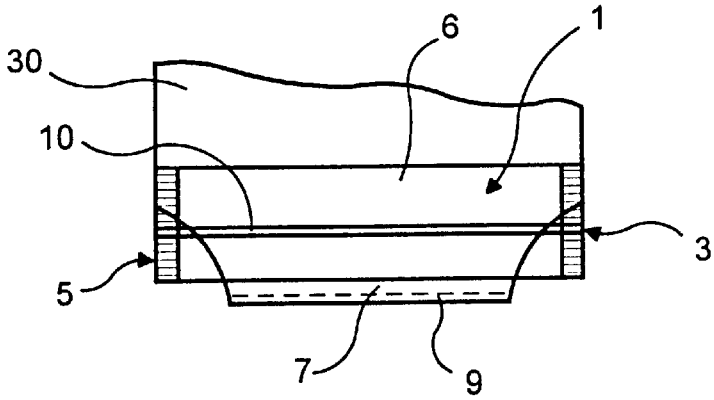
FIG. 12 is a top plan view of a reclosable bag provided with another example of the fastener.

FIG. 11 shows a variant of the fastener 1 shown in FIG. 10. According to this variant, a thin web 7 forms the U-shaped groove between the profiles 10, 12. This thin web 7 can easily be tom to open the reclosable bag 30 but it ensures that the fastener 1 is substantially watertight. If thin web 7 extends sufficiently, it can be turned inside out toward and between the webs 6, 8 when the contents of the reclosable bag 30 are emptied to protect profiles 10, 12 from the contents of the reclosable bag 30. Profiles 10, 12, thus protected, remain clean and able to work together effectively when reclosing the reclosable bag 30. Thin web 7 can also form a funnel or pouring spout when it is pulled out from the reclosable bag 30, as shown, for example, in FIG. 12.

To form a pouring spout, for instance, the thin web 7 consists of two substantially trapezoidal-shaped elements placed one over the other and joined together at the two non-parallel edges of the trapezoids and on the shorter of the two parallel edges. The length of the longer of the two parallel edges of the trapezoid is equal to the dimension of the reclosable bag 30 transversely with respect to the direction of movement D of the film 50. These two non-parallel edges are welded between and with the longitudinal ends 3, 5 facing strips 2, 4.

Figure 13:
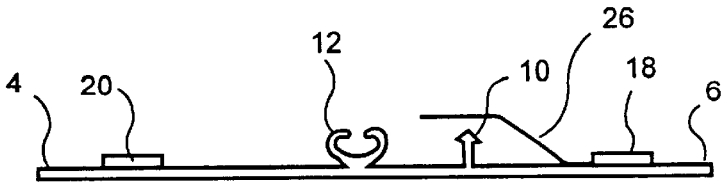
FIG. 13 is a cross-sectional view of another example of the fastener.

FIG. 13 shows a fastener 1 that includes, a gasket membrane 26 in addition to peel seal strips 18, 20, the complementary profiles 10, 12 and the webs 6, 8. Membrane 26 is welded over the entire length of the fastener 1, for example, close to the peel seal strip 18 between this peel seal strip 18 and profile 10. This gasket membrane 26 extends sideways toward the other profile 12 and covers profile 10.

Figure 14:
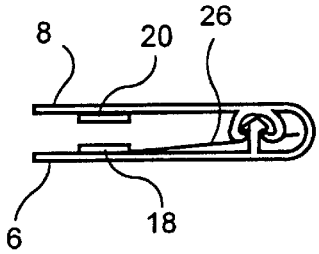
FIG. 14 is a cross-sectional view of the fastener shown in FIG. 13 in a closed configuration.

FIG. 14 shows the fastener 1 shown in FIG. 13 in the closed position. It is clearly shown that the sealing membrane 26 is engaged between profiles 10 and 12.

Figure 15:
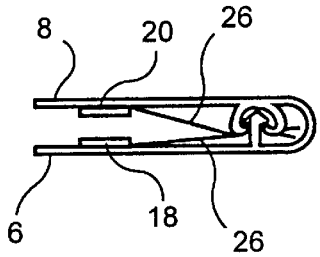
FIG. 15 is a cross-section view of another variant of the fastener.

FIG. 15 shows a fastener 1 similar to that illustrated in FIGS. 13 and 14, except that fastener 1 shown in FIG. 15 includes two gasket membranes 26 each welded to one of the webs 6, 8. It will be appreciated that the gasket membranes 26 of foregoing embodiments may include a perforation located in close proximity to the point of attachment of the gasket membrane 26 to the web 6, 8. Such perforation facilitates removal of gasket membrane 26 from web 6, 8.

FIGS. 16 through 20 show variants of fastener 1 that include at least one peel seal strip 18, 20, 21 and a perforated line 19.

Figure 16:
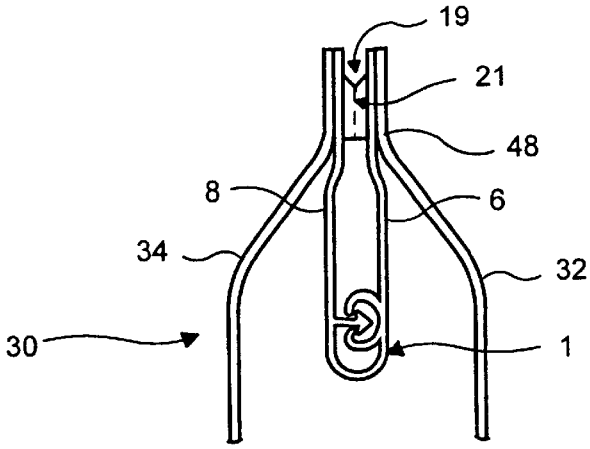
FIG. 16 is a cross-sectional view of the top of a reclosable bag that includes another variant of the fastener.

FIG. 16 shows a fastener 1, which has a single peel seal strip 21 attached between webs 6 and 8. The perforated line 19 is located on the edge of peel seal strip 21 located toward the outside of the reclosable bag 30 and between webs 6 and 8. This perforated line 19 extends over the entire length of the fastener 1 and permits the peel seal strip 21 to be more easily pulled apart when the walls 32 and 34 are separated to open the reclosable bag 30.

Figure 17:
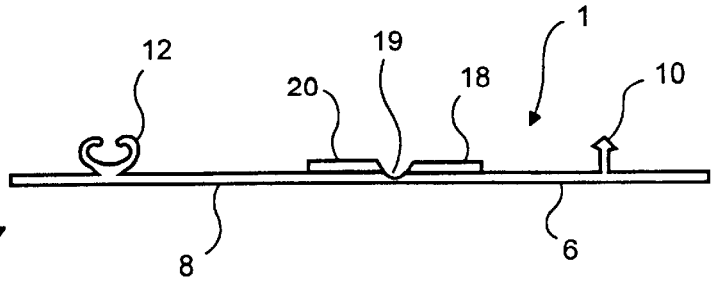
FIG. 17 is a cross-sectional view of another variant of the fastener.

FIG. 17 shows a fastener 1 in an open configuration. The perforated line 19 is located between profiles 10 and 12, at approximately the same distance from each of profiles 10, 12, at the junction point of webs 6, 8. Peel seal strips 18, 20 run along this perforated line 19 over the entire length of the fastener 1.

Figure 18:
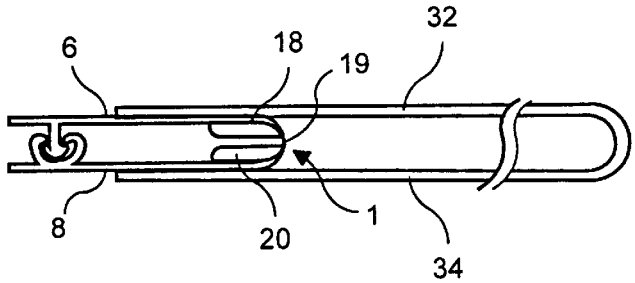
FIG. 18 is a cross-sectional view of the fastener shown in FIG. 17 in the closed configuration.
Figure 19:
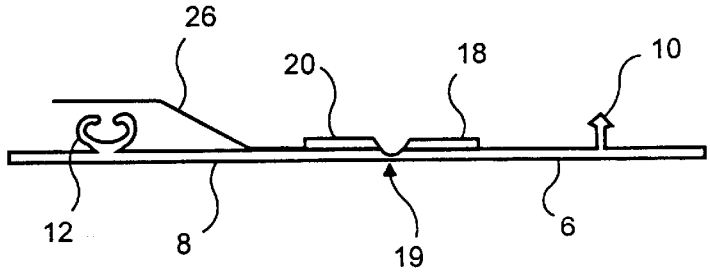
FIG. 19 is a cross-sectional view of another variant of the fastener.
Figure 20:
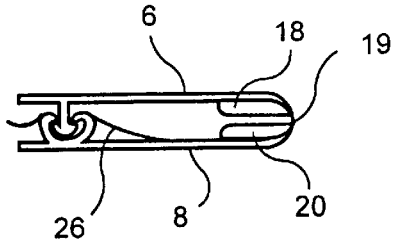
FIG. 20 is a cross-sectional view of the fastener shown in FIG. 19 in a closed configuration.

FIGS. 19 and 20 show a fastener 1, such as that shown in FIGS. 17 and 18, which also includes gasket membrane 26. This gasket membrane 26 is welded to the web 8 close to the peel seal strip 20 and extends sideways above profile 12.

FIG. 21 shows fastener 1 attached to a film 50 (for example before passing over the filling tube 130 of an FFS machine). This fastener 1 consists of two webs 6, 8 connected together to form a U-shaped cross-section. The web 6 is attached to the film 50 by two weld points 47, 49 located on the web 6 on either side of the longitudinal direction of profile 10. These weld points 47, 49 can be made before the fastener 1 is folded back onto itself to engage profiles 10, 12. The weld points 47, 49 can extend more or less in the longitudinal direction of the strips 2, 4 or may extend over the entire length of the fastener 1. According to another variant, the fastener 1 can be held onto the film 50 by only one weld point 47. Preferably, in this case, weld point 47 is the located downstream in relation to the movement D of the film 50, so as to prevent fastener 1 from turning upside down when passing over the filling tube 130.

Advantageously, one of these weld points 47, 49 is located on the side of profiles 10, 12 which will be inside the reclosable bag 30 once it is formed. In this case, no equivalent facing weld point will be made on the second web 8. Thus, a hinged configuration is created that gives the reclosable bag 30 greater resistance to internal pressure as seen, for example, in FIG. 22.

Figure 23:
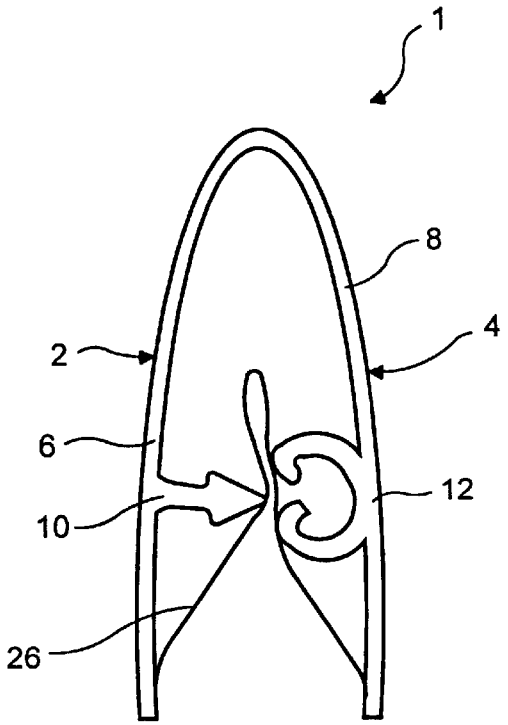
FIG. 23 is a cross-sectional view of yet another variant of the fastener.

FIG. 23 illustrates an alternative embodiment of the fastener 1 shown in FIG. 15. Fastener 1 includes a single gasket membrane 26, which is welded on each end thereof to a respective one of webs 6, 8 on the interior side of the profiles 10, 12. Alternatively, gasket membrane 26 may be attached to the walls 32, 34 of the reclosable bag 30. The gasket membrane 26 is interposed between the profiles 10, 12 to form a fluid-tight seal between the interior and exterior of the reclosable bag 30. The profiles 10, 12 may be engaged or disengaged, and the gasket membrane 26 may be perforated near the point of attachment to either one or both of the webs 6, 8. Such perforation facilitates removal of the gasket membrane 26 when the reclosable bag 30 is opened for the first time, thereby providing a tamper evident barrier. Alternatively, the portion of the gasket membrane 26 located on the exterior side of the profiles 10, 12 may be perforated.

Figure 25:
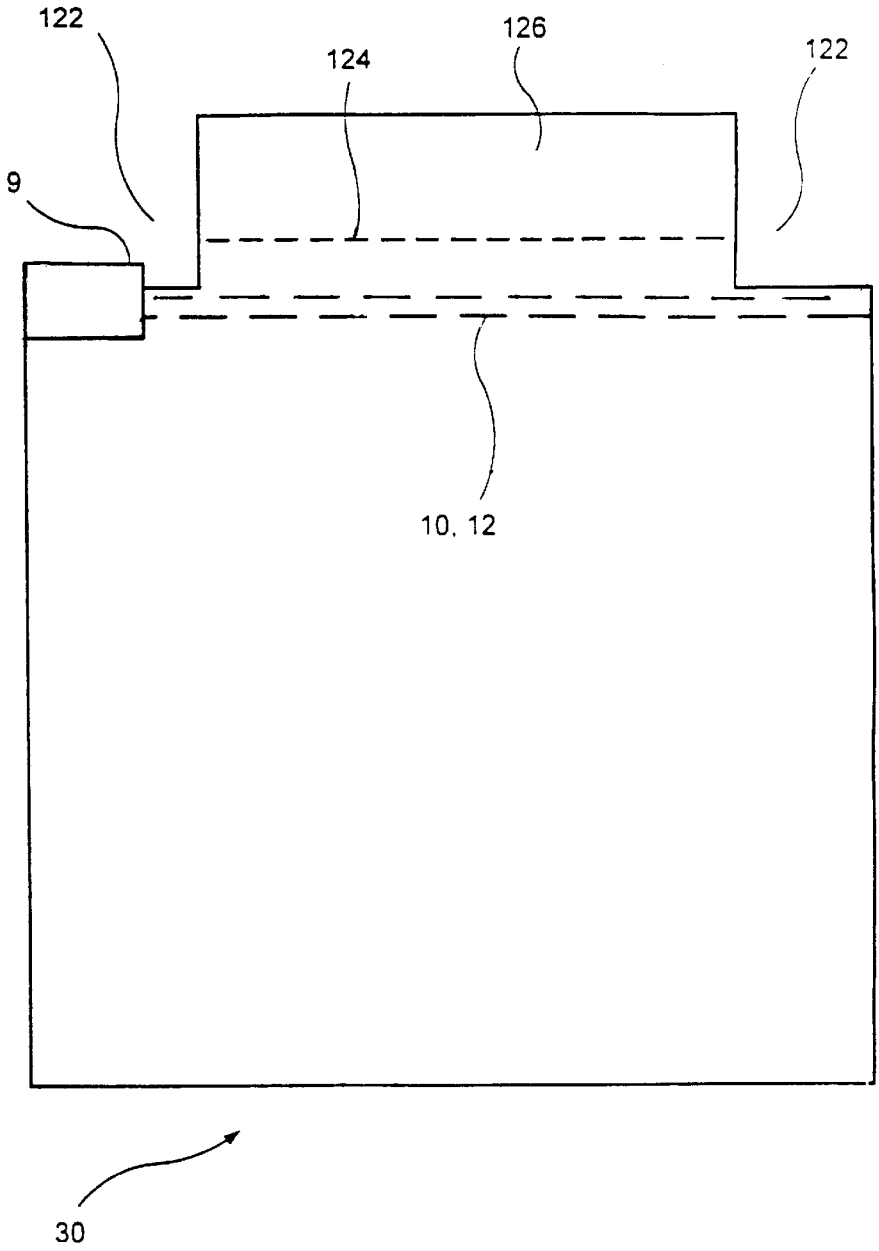
FIG. 25 is a top plan view of a tamper-evident reclosable bag.

FIG. 25 is a top plan view of another alternative for providing a tamper-evident slider-operated fastener, which requires replacing the cut-outs 51 and 53 with only side cuts 122, which extend above the longitudinal weld made by weld bars 110 for a short distance beyond profiles 10, 12. Accordingly, a film extension 126 beyond the profiles 10, 12 and slider 9 is formed. The film extension 126 is then sealed by cross-weld bars 116. Perforations 124 parallel and above the profiles may also be made. The resulting open-ended loop thus formed above the slider-operated fastener must be tom off along the perforations before the slider can be used to open the bag 30.

It will be appreciated that the gasket membrane 26 of the several embodiments described above may, if of sufficient thickness, be provided for maintaining the profiles 10, 12 out of engagement when attaching the fastener 1 to walls 32, 34. It will be further appreciated that if the gasket membrane 26 is interposed between engaged, or interlocked, profiles 10, 12, a pulling action on the walls 32, 34 of a formed reclosable bag 30, the gasket membrane 26 will act to separate the engaged, or interlocked, profiles 10, 12.

Figure 24:
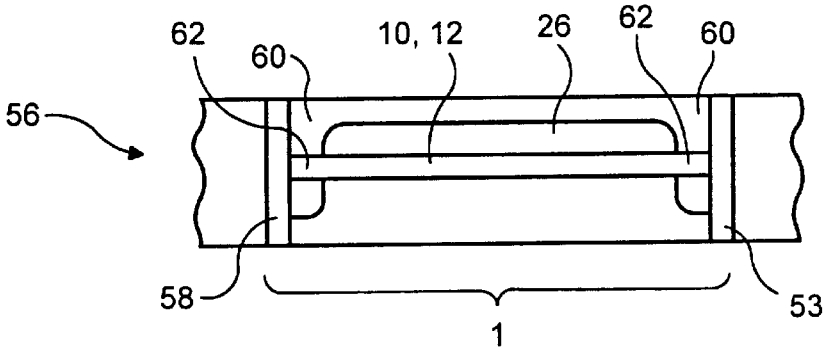
FIG. 24 is a top plan view of a tape of the fasteners.

FIG. 24 illustrates a section of a tape 56 being comprised of series of fasteners 1, which are provided with gasket membranes 26 according to any of the embodiments described above. The tape 56 includes cross-seals 58, which define the extent of each fastener 1 and are spaced apart a distance approximately equal to the width of the reclosable bag 30 to be formed. The gasket membrane 26 includes a cut-out portion 60 located in closed proximity to the cross-seals 58 so that profiles 10, 12 may be positively engaged in the area of the cut-out portion 60. Profiles 10, 12 may be engaged or disengaged over the remaining length of gasket membrane 26. The positive engagement area 62 of profiles 10, 12, which substantially corresponds to the cut-out portion 60 of gasket membrane 26, ensures alignment of the profiles 10, 12 over the remaining length of fastener 1 and gasket membrane 26.

It is clear that the invention also extends to a machine for producing a film 50 to be used to form reclosable bags 30, including first welding means 110 which are transversal to the direction of movement of the film 50, and capable of attaching a fastener 1 with webs 6, 8 to this film 50.

Thus, one obtains a film 50 for forming reclosable bags 30 with fasteners 1. These fasteners 1 may be attached to the film 50 only by a first web 6. Recloseable bags 30 may then be formed and completed from this film 50 provided with fasteners 1 either on a bag forming machine to be used and filled later, or on an FFS machine.

The invention therefore also covers a forming, filling and sealing machine which include first transversal welding means 110 upstream of a filling tube 130 and second transversal welding means 116 below the tube 130. The term transversal to be understood herein to refer to the direction of movement of the film 50.

It will be appreciated that although the gasket membrane 26 has been described hereinabove being welded or attached to one or both of the webs 6, 8, the gasket membrane 26 may alternatively be welded or otherwise attached to one or both of the walls 32, 34 of the reclosable bag 30.

Thus, the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A method of manufacturing a film to form a reclosable bag, comprising the steps of moving the film;

forming first cut-outs on said film;

positioning a fastener sequentially and crosswise with respect to the direction of movement of said film and over the first cut-out, said fastener comprising a first strip with said fastener containing at least one reclosable profile interlocked with another reclosable profile that is complementary thereto and contained by a second strip;

wherein each of said first and second strips contains at least one web extending substantially in the direction of movement of said film on one side of the profile contained thereon;

and wherein said fastener includes a slider for opening and closing said fastener;

welding said first strip of said fastener to the bag front section of said film;

forming a tube from said film with opposing panels with one of said panels forming said bag front section; and sealing said second strip to the second opposite panel which forms the bag rear section.

2. The method according to claim 1, wherein one of said webs is welded to the film on at least one edge of the first cut-out.

3. The method according to claim 1, further comprising the step of forming a second cut-out in the film opposite to said first cut-out.

4. The method according to claim 1, wherein said film includes side cuts, said fastener being attached to said film so that film extensions extend from an edge of said side cuts adjacent said fastener to beyond said reclosable profiles and said slider, said film extensions being sealed together beyond said reclosable profiles and said slider.

5. The method according to claim 4, wherein said sealed film extensions include a perforation disposed beyond said reclosable profiles and said sealing slider and substantially parallel to said reclosable profiles.

6. The method according to claim 5, wherein said film extensions must be torn along said perforation before said slider may be used to open and close said fastener.

7. The method according to claim 1, further comprising a step of aligning said slider with one of guide grooves or ribs of a filling tube of a forming, filling and sealing machine.

* * * * *